US005143146A

United States Patent [19]

Watson

[11] Patent Number: 5,143,146

[45] Date of Patent: Sep. 1, 1992

[54] CASTING OF METAL STRIP

[75] Inventor: W. Gary Watson, Cheshire, Conn.

[73] Assignee: Olin Corporation, Cheshire, Conn.

[21] Appl. No.: 740,747

[22] Filed: Aug. 6, 1991

[51] Int. Cl.[5] ..... B22D 11/06

[52] U.S. Cl. ..... 164/479; 164/429

[58] Field of Search ..... 164/429, 423, 479, 463, 164/444, 486

[56] References Cited

U.S. PATENT DOCUMENTS 4,789,022 12/1988 Ohno .

FOREIGN PATENT DOCUMENTS 242063 10/1962 Australia ..... 164/429

OTHER PUBLICATIONS

J. Herbertson et al, "Strip Casting Studies at BHP Central Research Laboratories", CCC'90 Fifth International Casting Conference, Voest Alphine, Industrieanlangenbau, Linz, Jun., 1990.

J. Herbertson et al, "A Novel Concept for Metal Delivery to Thin Strip Casters Casting of Near Net Shaped Products", TMS-AIME, pp. 335-349.

J. Herbertson et al, "Fluid Dynamics in High-Speed, Strip-Casting Metal Delivery System", International Conference on New Smelting Reduction of Near Net Shape Casting Technologies for Steel, SRNC-9, J. S. Truelove, pp. 1/10-11/10.

*Primary Examiner*—Kuang Y. Lin

*Attorney, Agent, or Firm*—Bruce E. Burdick; H. Samuel Kieser

[57] ABSTRACT

A method of casting metal wherein the molten metal is deposited on a moving planar substrate formed from an insulating refractory material. The deposited liquid metal is maintained as a liquid until the turbulence induced by the pouring of the metal onto the substrate is minimized.

10 Claims, 1 Drawing Sheet

CASTING OF METAL STRIP

BACKGROUND OF THE INVENTION

1. Field of the Invention

This invention relates generally to the casting of metal, and more particularly, to an improved method and apparatus for the casting of metal strip or sheet in a continuous operation.

2. Background Information

The metals industry has been developing processes and apparatus for producing an as-cast product that needs little or no additional processing such as hot rolling to reduce it to strip form. One such process that has arisen as a result of this development is the single belt casting process In this process, molten metal is caused to flow onto a moving horizontal surface in the form of a continuous belt whereupon it solidifies as it moves along with the belt. The elongated solid strip of metal is removed from the continuous belt for further processing as desired.

As attempts have been made to increase the speed of casting as measured in inches per minute of the cast strip, as well as to reduce the thickness of the cast alloys to eliminate further processing operations, several problems have arisen in connection with the feeding of the molten metal onto the belt due to the splashing and turbulence caused by the relative flow between the melt and the belt.

Normally the source of molten metal is usually spaced at some vertical distance from the belt. When the molten metal is caused to flow directly from the source of the molten metal through the vertical distance into the belt, the melt will tend to splash as it hits the belt which may result in porosity in the cast product as well induce turbulence which can cause inclusions such as oxides and folds and creases in the outer surface of the solidified strip.

The typical approaches undertaken in an attempt to solve these problems involves improvements in the feeding means such as providing a tundish between the source of molten metal and the belt. Such feeding means normally takes the stream of molten metal issuing from the source and discharges it outwardly in the direction of movement of the belt. Although this approach solves the problem of splashing, the problem of dampening of its flow to reduce turbulence still remains.

The following references contain a discussion of various delivery systems used for the delivery of the melt to belt casters.

J. Herbertson, P. C. Campbell, A. G. Hunt and J. Freeman, "Strip Casting Studies at BHP Central Research Laboratories", *CCC'90 Fifth International Casting Conference,* Voest Alpine, Industrieanlangenbau, Linz, June, 1990; J. Herbertson and R. I. L. Guthrie, "A Novel Concept for Metal Delivery to Thin Strip Casters", *Casting of Near Net Shaped Products,* TMS-AIME, pp 335–349; and J. S. Truelove, T. A. Gray, P. C. Campbell and J. Herbertson, "Fluid Dynamics in High-Speed Strip-Casting Metal Delivery System", *International Conference on New Smelting Reduction of Near Net Shape Casting Technologies for Steel,* SRNC-9, J. S. Truelove, pp. 1/10–11/10.

SUMMARY OF THE INVENTION

While a great deal of attention has been directed toward the development of feed systems to reduce or minimize liquid metal turbulence so as to produce a high quality strip, the efforts in this direction have not been totally satisfactory.

Accordingly, it is an object of the Present invention to provide an improved casting system for minimizing liquid metal turbulence.

In accordance with the present invention, the turbulence is minimized by allowing the incoming liquid metal to damp itself by delaying solidification until the desired degree of damping occurs. This may be accomplished in accordance with the present invention by virtue of a process in which a moving substrate is passed beneath a source of molten metal with a planar portion thereof passes through a position at which a deposit of molten metal is placed on the substrate. The molten metal is maintained as a liquid on the moveable substrate until the turbulence is damped by itself and is thereafter cooled to induce solidification.

BRIEF DESCRIPTION OF THE DRAWINGS

The present invention may be more readily understood by reference to the following detailed description and to the accompanying drawings in which.

DETAILED DESCRIPTION

The present invention is directed to the casting of strip or sheet from molten metal. By strip or sheet is meant metal having a rectangular cross-section of greater width than thickness and in which the thickness is between about ⅛ to about ¾ inch and preferably between about ¼ to about ½ inch. While the invention may be applicable to many metals, it is particularly applicable to the casting of copper or copper alloys.

Figure 1:
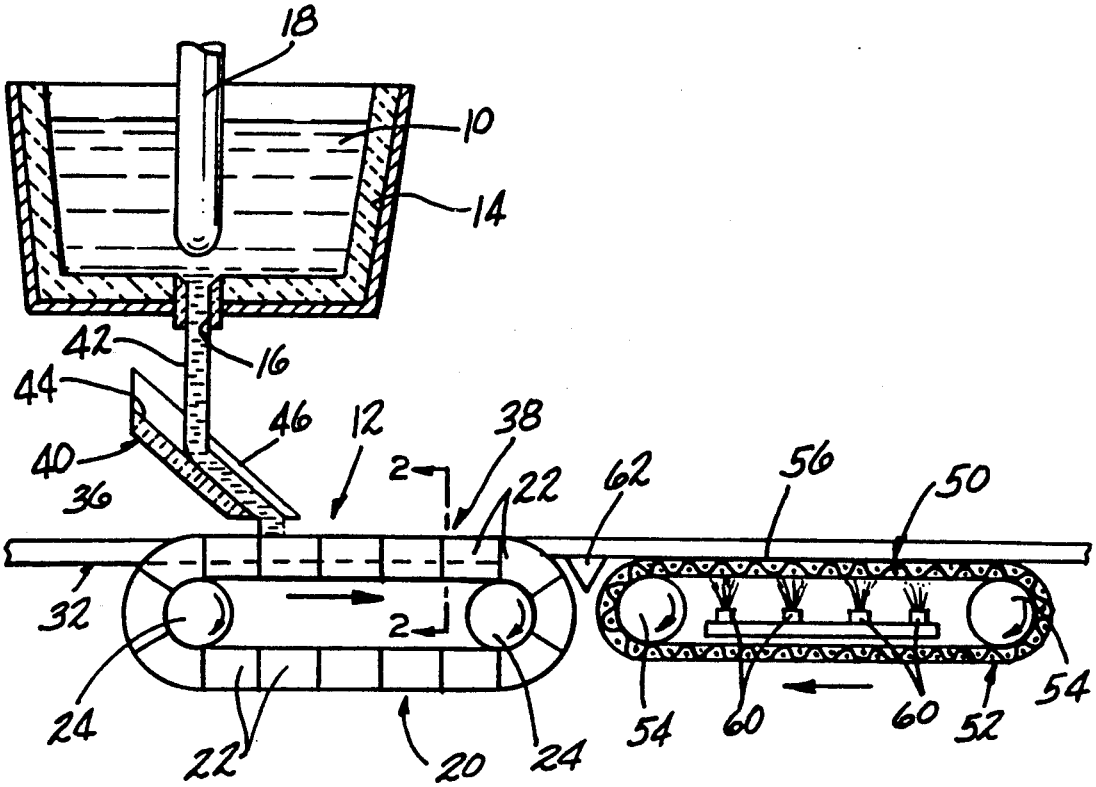
FIG. 1 is a schematic elevational view, partially in section, of a casting apparatus incorporating the present invention.

Referring to the drawings, and in particular to FIG. 1, there is shown schematically a casting system which incorporates the present invention. The molten metal 10 may be supplied to the casting apparatus 12 from a refractory lined vessel 14 having a discharge opening 16 therein. A plunger 18 is provided in the interior of the vessel 14 which is associated with the discharge opening 16 to control the flow of molten metal from the vessel 14. For this purpose, the plunger 18 may be vertically reciprocated by any suitable mechanism (not shown).

A continuously moving substrate arrangement 20 is mounted beneath the discharge opening 16 of the vessel 14. The substrate arrangement 20 may include a continuous belt or caterpillar of a plurality of interconnected segments or blocks 22 extending between horizontally spaced rollers 24. One of the rollers 24 may be connected to a suitable drive means (not shown) to drive the segmented belt 24 at the proper speed and in the direction indicated by the arrow. These segments or refractory blocks 22 are fabricated from a suitable refractory material which acts as an insulator against the transfer of heat from the molten metal cast upon it.

Figure 2:
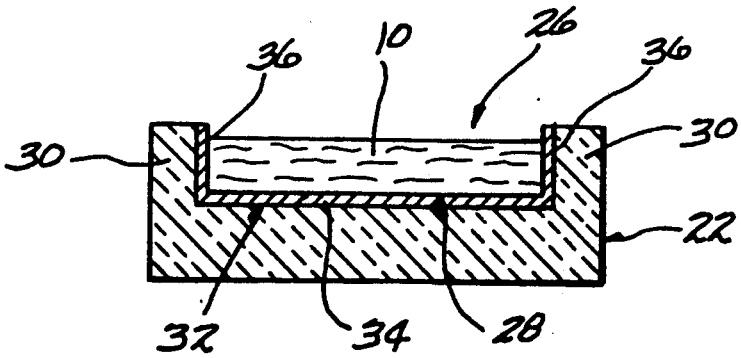
FIG. 2 is a sectional view taken along the lines 2—2 of FIG. 1.

As shown in FIG. 2, the blocks have a trough portion 26 formed therein extending inwardly from the outer surface thereof. The trough 26 is formed by a flat bottom surface 28 and opposed sidewalls 30. The trough portions 26 form a continuous trough in the substrate arrangement 20 which extends in the direction of the movement thereof.

A preformed foil material 32 having a bottom surface 34 and sidewalls 36 is fed onto the upper run 38 of the substrate assembly 20 and is adapted to move along with the blocks 22. The foil is so shaped such that it fits within the trough portions 26 in the blocks 22. The foil material may be made from low carbon steel though any steel alloy ranging from low carbon to stainless steel may be used. The foil must be of sufficient thickness such that the molten metal will not dissolve through it prior to the molten metal being cooled. The foil preferably should have a thickness of 0.01 inch or less and may generally be between 0.002 and 0.01 inch. The foil may be shaped into its trough-like cross-section by any suitable means (not shown) such as shaping bars or rollers. The foil 32 is fed from a suitable supply to the upper run 38 of the substrate assembly 20 and is moveable therewith.

Feeding means such as a refractory lined tundish 40 is provided between the vessel 14 and the continuous substrate arrangement 20 in a position to be contacted by the stream 42 of the molten metal issuing from the outlet 16 of the vessel 14. The tundish 40 may include a refractory lined trough-like -member having a generally flat inclined bottom surface 44 with vertically extending side edges 46. The tundish 40 is inclined as shown in FIG. 1 such that its flat planar bottom surface 44 is inclined downwardly toward the downstream end of the upper run 38 of the continuous substrate 20.

A supporting surface 50 is provided downstream of the upper run of the moving substrate 20. This supporting surface 50 is of a filter-type material such as expanded mesh through which air and water can pass. The supporting surface 50 may be in the form of a continuous belt 52 mounted on rollers 54 and providing a planar upper run 54 coplanar with the bottom of the troughs 26. The continuous belt 52 moves in the direction as indicated by the arrow in FIG. 1. Alternatively, the supporting surface 50 may be in the form of a table and pinch rollers may be provided downstream thereof to grip the foil and cast strip and pull it across the table. The expanded mesh may be fabricated from steel although such other materials as copper, copper alloys and aluminum may be used.

Cooling sprays 60 are provided underneath the upper run 52 of the supporting mesh material 50 to cool the bottom surface of the foil and strip contained thereon.

A static support surface 62 may be provided which is coplanar with the bottom of the trough of the upper run 38 of the substrate assembly 20 and the upper run 56 of the supporting surface 50 to close the gap therebetween.

In operation, the molten metal is caused to flow from the tundish 40 into the troughs 26 in the refractory blocks forming the upper run of the continuous belt which is lined with the preshaped foil 32. The length of the upper run 38 of the moving substrate 20 in which the metal is in contact should be long enough to ensure that the molten metal contained therein remains liquid until the turbulence is damped by itself and the molten metal becomes a static fluid in contained by the foil in the troughs and has reached a quiescent state with respect to the foil. During this process, no cooling of the refractory blocks 22 or molten metal is provided. The preformed foil 32 may be inductively preheated to minimize distortion upon being contacted by the molten metal feed. While the contact length of the upper run of the moving belt will vary depending upon the alloy being cast, in the case of copper alloys it is thought that the upper run need be no longer than about 6 to about 10 inches and probably about 8 inches.

After the molten metal has become quiescent, the metal and foil passes onto the supporting planar surface 50 where the cooling is applied by the cooling sprays 60. The cooling sprays 60 spray water or other cooling fluids upwardly through the mesh material of the planar surface 50 against the bottom side of the foil. After completely solidifying, the cast metal and the foil are removed from the supporting surface 50, it may be further processed as desired.

The foil, if it becomes welded to the cast metal strip, may be removed by conventional milling. The foil may also be coated with an appropriate material such as boron nitride or graphite before the molten metal is deposited thereon so as to permit the foil to be separated from the solidified strip and reused.

By virtue of the above-described arrangement, the turbulence of the liquid being cast upon a horizontal moving belt is minimized by maintaining the cast metal on the moving belt as a liquid until the turbulence dissipates itself at which time the cast molten metal is cooled to provide a solidified strip.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A process for casting metal into sheet or strip comprising:
   a. providing a source of molten metal,
   b. passing a moving substrate underneath the source of molten metal with a planar portion thereof passing through a position at which a deposit of molten metal is placed on said substrate,
   c. feeding said molten metal onto said substrate, and
   d. maintaining said molten metal on said substrate as a liquid until turbulence is dissipated and thereafter and cooling the metal to form a solidified strip.

2. The process of claim 1 wherein said moving substrate comprises a refractory material.

3. The process of claim 2 further comprising providing a foil material on said substrate between the source of molten metal and said substrate to receive the molten metal.

4. The process of claim 3 wherein said substrate has a trough therein and said foil is fed onto and moves with said substrate and lines said trough, said foil and molten metal remaining on said substrate until said molten metal becomes quiescent with respect to said foil and thereafter removing said foil and metal from said substrate onto a support surface and cooling said molten metal.

5. The process of claim 4 wherein said supporting surface is mesh and said cooling of said metal includes water sprays directed against the bottom of said foil through said mesh.

6. An apparatus for casting metal into sheet or strip comprising:
   a. means for feeding molten metal, b. a moving substrate having a planar portion placed underneath said feeding means in a position to receive a deposit thereon, c. said substrate being of a refractory material, the length thereof being long enough for maintaining said molten metal as a liquid until the turbulence from said feeding is dissipated, and d. cooling means located downstream of said moving substrate for cooling said molten metal to form a solidified strip.

7. The apparatus of claim 6 further comprising means for providing a foil material on top of said moving substrate as it passes underneath said source of molten metal whereby said molten metal is deposited on said foil.

8. The apparatus of claim 7 wherein said moving substrate comprises an endless series of refractory blocks, said blocks having a trough formed in their outer surfaces, said foil lining said trough as it passes underneath said feeding means.

9. The apparatus of claim 8 further said cooling means including a supporting surface spaced downstream of said substrate, said supporting surface adapted to receive said foil and metal after said metal has become substantially quiescent in said foil, and means for cooling said metal after it is received on said supporting surface.

10. The apparatus of claim 9 wherein said supporting surface is a mesh material and said cooling means includes a water spray directed upwardly through said mesh against the bottom of said foil.

* * * * *

UNITED STATES PATENT AND TRADEMARK OFFICE

CERTIFICATE OF CORRECTION

PATENT NO. : 5,143,146

DATED : September 1, 1992

INVENTOR(S) : W. Gary Watson

It is certified that error appears in the above—identified patent and that said Letters Patent is hereby corrected as shown below:

In column 4, line 46 delete "and" before "cooling".

Signed and Sealed this

Twenty-eighth Day of September, 1993

Bruce Lehman

*Attest:*

BRUCE LEHMAN

*Attesting Officer*

*Commissioner of Patents and Trademarks*